US006149380A

United States Patent [19]

Kuzniar et al.

[11] Patent Number: 6,149,380

[45] Date of Patent: Nov. 21, 2000

[54] HARDWALL FAN CASE WITH STRUCTURED BUMPER

[75] Inventors: Stanislaw Kuzniar, Mississauga; Czeslaw Wojtyczka, Brampton, both of Canada

[73] Assignee: Pratt & Whitney Canada Corp., Longueuil, Canada

[21] Appl. No.: 09/244,132

[22] Filed: Feb. 4, 1999

[51] Int. Cl.[7] ..... F01D 25/16

[52] U.S. Cl. ..... 415/9; 415/173.4; 415/174; 415/200

[58] Field of Search ..... 415/9, 173.4, 174.4, 415/200

[56] References Cited

U.S. PATENT DOCUMENTS

| | | | |
|---|---|---|---|
| 4,197,052 | 4/1980 | Lardellier . | |
| 4,648,795 | 3/1987 | Lardellier . | |
| 5,160,248 | 11/1992 | Clarke . | |
| 5,188,505 | 2/1993 | Schilling et al. . | |
| 5,437,538 | 8/1995 | Mitchell | 415/9 |
| 5,486,086 | 1/1996 | Bellia et al. | 415/9 |
| 5,885,056 | 3/1999 | Goodwin | 415/9 |

FOREIGN PATENT DOCUMENTS 0030179 10/1981 European Pat. Off. .

*Primary Examiner*—Edward K. Look
*Assistant Examiner*—Rhonda Barton
*Attorney, Agent, or Firm*—Jeffrey W. Astle

[57] ABSTRACT

The invention provides a novel hardwall fan case for encasing the radial periphery of a forward fan in a gas turbine engine. The fan case includes a rigid annular fan case shell spaced a selected radial distance from the tips of the fan blades, thus defining an annular internal air path surface of the fan case. The shell has a rigid hardwall fore section generally parallel to the blade tips and coated with a fore layer of abradable material. The fore section serves as a hardwall to limit the radial movement of fan blades deflecting under bird strike conditions and thereby to control the erosion of fan case linings. Limiting the radial blade deflection thus maintains the resulting fan tip clearance within acceptable limits. Uncontrolled or excessive erosion of fan case linings during bird strike conditions has in the past led to potentially catastrophic engine surge conditions where highly aerodynamically loaded fans are used that are very sensitive to enlarged tip clearances. The aft section of the rigid shell is radially spaced from the fore section thus defining a recess between the aft section of the rigid shell and the air path surface. The recess houses compressible material that absorbs the impact of the broken blade fragment propelled radially, and can retain the fragment in certain conditions. However, the rigid shell includes a novel rigid bumper between the fore and aft sections. The bumper has a rigid rear edge disposed an offset distance forwardly of the fan blade centers of gravity. When a broken blade fragment is propelled radially under centrifugal force, the fragment strikes the bumper edge. The blade fragment is rotated about the bumper edge under a force moment equal to the centrifugal force multiplied by the offset distance. As a result, the blade fragment is redirected from a radial trajectory and is rotated rearwardly to be ejected axially through the gaspath, or alternatively is retained within the compressible material housed in the rigid shell. Both the rigid hardwall fore section and the aft compressible material are preferably covered with a relatively thin layer of abradable material that allows the rotating fan blades on initial operation to achieve close tip tolerance with the hardwall fan case.

11 Claims, 2 Drawing Sheets

HARDWALL FAN CASE WITH STRUCTURED BUMPER

TECHNICAL FIELD

The invention is directing to an improved casing for a fan of a turbo fan engine comprising a hardwall fore section serving as a rigid bumper in order to limit the radio deflection of the fan rotor in the event of a bird strike condition and a compressible aft section containing and absorbing the impact of a detached blade or blade fragment, deflected rearwardly from the rigid bumper.

BACKGROUND OF THE ART

The fan case of a turbofan engine performs several functions in association with the rotating fan in operation. The aerodynamic function of the fan case is to direct the axial flow of air in conjunction with the fan.

Typically the fan directs a primary air stream through the compressor and turbines of the engine and secondary airflow through an annular radially outward bypass duct. For the aerodynamic function of the fan case, it is essential that the clearance between the rotating fan blades and the internal surface of the fan case be kept within an acceptable range to maximize the fan efficiency.

It is common practice to line the internal air path surfaces of the fan case with an abradable material. On initial operation of the engine and rotation of the newly manufactured fan, the abradable material is rubbed off on contact with the tips of the rotating fan blade. For example, in the case of small gas turbine engines with a fan of diameter approximately 24 inches, the thickness of the abradable layer of material is in the order of 0.070 inches. At assembly conditions, the tip clearance is in the order of 0.005 to 0.030 inches. During the high speed rotation of the fan, the fan blades stretch elastically under the load of centrifugal force in the order of 0.020 to 0.040 inches. Due to the dynamic stretching of the metallic blades, the abradable material is abraded on contact with the fan blade tips. Due to manufacturing tolerances, each fan blade will have its unique variation and the actual degree of running clearance required and stretching of blades will vary a certain amount between different fans when manufactured. The provision of abradable material therefore allows for close tolerance or minimizing of clearance between the fan blade tips and the annular internal air path surface of the fan case.

In the case of small turbofan engines in particular, the clearance between fan blade tips and the fan case internal surface is often of a critical nature. Due to a high aerodynamic loading of the blades, the fan stage stall margin is sensitive to the tip clearance. Abnormal changes in tip clearance can adversely affect the engine thrust and surge margin, which must be avoided at all costs.

The fan of the turbo fan engine must comply with regulations intended to ensure safe operation of the turbofan engine in two critical conditions; firstly, on the ingestion of birds which strike the fan blading; and secondly, in the event of breakage of a fan blade. These two conditions are known generally as a "bird strike event" and a "blade off event".

In the prior art, a bird striking the fan generally results in an increase of tip clearance between the fan blade tips and the internal surface of the fan case. The soft abradable material bonded to the interior surface of the fan case is removed together with compressible material radially outward of the abradable material when the bird strike condition is encountered as follows. When an outboard bird is ingested into the forward fan area, the fan blades cut the bird into fragments and propel the fragments tangentially and axially rearwardly. The bird fragments are then expelled axially through the outward annular by-pass duct. However, in case of bird ingestion, some bird fragments are ingested into the engine core through the compressor and turbines.

Of particular interest to the present invention is the effect of a bird strike and resulting interaction of the fan blades with the fan case. The fan blades are deformed due to interaction. The axial and radial unbalanced loads are transmitted to the low power shaft, the supporting structure and the engine mounts. Therefore, the fan rotor will deflect radially outwardly and cut deeply into the compressible material and abradable material which lines the interior surface of the fan case.

Prior art fan cases for small engines are lined with approximately 0.100 to 0.300 inches of abradable material applied on the interior surface of an approximately 0.300 to 0.500 inch thick layer of compressible material. Twisted and deflected fan blades severely cut into these materials and lead to excessive fan tip clearances.

On a bird strike event, regulations require that the engine thrust decreases to no less than 75% of maximum engine thrust within 20 minutes after the bird strike. A number of engine components may be damaged due to the bird strike, however, the cumulative effect of various types of damage cannot reduce the total engine thrust by more than 25%. Bird strikes may deform the fan blades, damage the engine core, or damage compressor blades in addition to increasing the fan blade tip clearance dramatically. It has been found through experiment that excessive fan blade tip clearance can result in 7 to 9% of the thrust loss alone. Considering that regulations require no more than 25% engine thrust loss, it can be seen that excessive fan blade tip clearance after a bird strike is a significant cause of engine thrust loss.

In the case of small engines of approximately 24" fan diameter, it is common to include a layer of compressible material and abradable material of between 0.300 to 0.500 inches. The combined effect of blade deformation and fan rotor out of balance rotation can remove significant amounts of materials, especially toward the leading and trailing edges of the fan blades. It is not uncommon to encounter removal of 0.200 to 0.300 inches of such materials.

It has also been found that some fans are extremely sensitive to excessive tip clearance, and will stall. It can be seen therefore, that excessive tip clearance can lead to dangerous surge conditions on encountering bird strike events.

The prior art has provided means to limit tip clearance problems on bird strike by providing a hardwall fan case which comprises a rigid fan case shell parallel to the fan blade tips lined with a thin layer of abradable material to compensate for manufacturing tolerances and stretch of the blades in operation. On excessive movement of the fan blades during a bird strike event, the fan blade tips wear away the abradable material and directly contact the hardwall of the fan case. Fan rotors in general, are integrally bladed rotors. The fan case is lined with a layer of abradable material, since there is a concern that tight clearance during running of the engine will result in dynamic coincidence when the integrally bladed rotor rubs against the hardwall containment fan case before the rotor stabilizes around its own centre of rotation. Abradable material is therefore used to line a hardwall fan case to give sufficient clearance to stabilize the rotor around its own centre of rotation, and to limit tip clearance during bird strike events.

A significant disadvantage of a hardwall fan case however, is encountered on the second condition required of fan rotors namely, when a fan blade breaks off in the blade off condition. Standard tests are conducted on engine designs wherein an explosive charge is detonated to break off a fan blade during high speed operation, the fan case structure provides important protection for aircraft and passengers since the rapid rotation of the fan propels broken fan blade fragments radially at high speeds. The fan case therefore, is provided to contain any broken fan blade fragments within the engine itself, or to eject such fragments axially rearwardly through the by-pass duct.

The fan case in the prior art is an essential component to ensure that catastrophic accidents do not occur as a result of fan blades breaking off.

A hardwall fan case has a disadvantage resulting from the shape of the internal air path surface. The air path surface generally converges radially inwardly as the air taken into the engine increases in pressure and decreases in volume. The internal air path surfaces are tapered in such a manner that a broken fan blade fragment will bounce off the hardwall fan case and be redirected forwardly. This condition is unacceptable since further catastrophic damage may occur. The nacelle in the front of the engine will not contain the blade fragments propelled with high energy. Regulations require that any broken fan blade fragment be directed axially rearwardly to avoid further damage, or be contained within the fan case itself. Deflection of broken fan blade fragments forwardly, as well radial expulsion through the fan case itself are dangerous and unacceptable.

As a result, it has been common to provide a relatively heavy fan case shell which is lined with compressible material coated with abradable material. The compressible material acts to absorb the impact of the high velocity fan blade fragments. The rigid shells of the prior art fan cases are often tapered forwardly so that the radially expelled broken fan blade fragments will deflect rearwardly off the rigid fan case shell rather than forwardly. A forwardly inwardly tapered rigid fan case shell is commonly used for this purpose. However, providing the required thick layer of compressible material shaping the air path surface leads to unacceptable large fan tip clearances during a bird strike event as mentioned above. In the case of relatively large engines however, excessive fan tip clearance is less critical than in small engines.

Therefore, it can be seen that in the prior art there is a conflict between two competing conditions that must be accommodated by fan cases and fan blades. In the case of a bird strike, it is preferred that a hardwall fan case be provided to maintain the fan tip clearance within acceptable limits. However, in the case of fan blade breakage, it is preferred to line the fan case with a relatively soft compressible material that can absorb the impact with broken fan blade fragments and which has a tapered rigid shell surface that can deflect any broken fan blade fragments rearwardly. Due to the shape of the air path, in order to deflect broken fragments rearwardly, a hardwall fan case is generally inappropriate. The shape of the air pathway tapers inwardly as it progresses rearwardly through the engine, and the pressure of air increases with corresponding decrease in volume. By providing a hardwall fan case which follows the air path shape, any broken fan blade fragments will be deflected forwardly and impose the risk of unacceptable accidental damage to the aircraft for adjacent people and property. It is acceptable only to either retain the broken fragments within the fan case itself, or to eject broken fan blade fragments axially rearwardly.

Therefore, it is desirable to provide a fan case structure which can maintain fan tip clearance within acceptable limits after a bird strike event while simultaneously ensuring that any broken fan blade fragments are directed axially rearwardly, or retained within the fan case structure itself.

It is also desirable to provide such a fan case structure that will use existing materials and technology without requiring significant rework or re-certification of existing designs.

DISCLOSURE OF THE INVENTION

The invention provides a fan case for encasing the radial periphery of a forward fan in a turbofan gas turbine engine. The fan case includes a rigid annular fan case shell spaced a selected radial distance from the tips of the fan blades, thus defining an annular internal air path surface of the fan case.

The fan case shell has a rigid hardwall fore section generally parallel to the blade tips and coated with a fore layer of abradable material. The fore section serves as a hardwall to limit the radial movement of fan blades deflecting under bird strike conditions and thereby to control the erosion of fan case linings. Limiting the radial blade deflection thus maintains the resulting fan tip clearance within acceptable limits. Uncontrolled or excessive erosion of fan case linings during bird strike conditions has in the past led to potentially dangerous engine surge conditions where engine thrust decreases below an acceptable level.

The aft section of the rigid shell is radially spaced from the fore section thus defining a recess between the aft section of the rigid shell and the air path surface. The recess houses compressible material that absorbs the impact of the broken blade fragment propelled radially, and can retain the fragment in certain conditions.

The rigid shell includes a novel rigid bumper between the fore and aft sections. The bumper has a rigid rear edge disposed an offset distance $\Delta X$ forwardly of the fan blade centres of gravity. When a detached blade or blade fragment is propelled outwardly under centrifugal force, the fragment strikes the bumper edge. The blade fragment is rotated about the bumper edge under a force moment equal to the centrifugal force multiplied by the offset distance. As a result, the blade fragment is redirected from a radial trajectory and rotated rearwardly for rearward ejection axially through the gaspath, or alternatively for retention within the compressible material.

Both the rigid hardwall fore section and the aft compressible material are preferably covered with a relatively thin layer of abradable material that allows the rotating fan blades on initial operation to achieve close tip clearance with the hardwall fan case.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
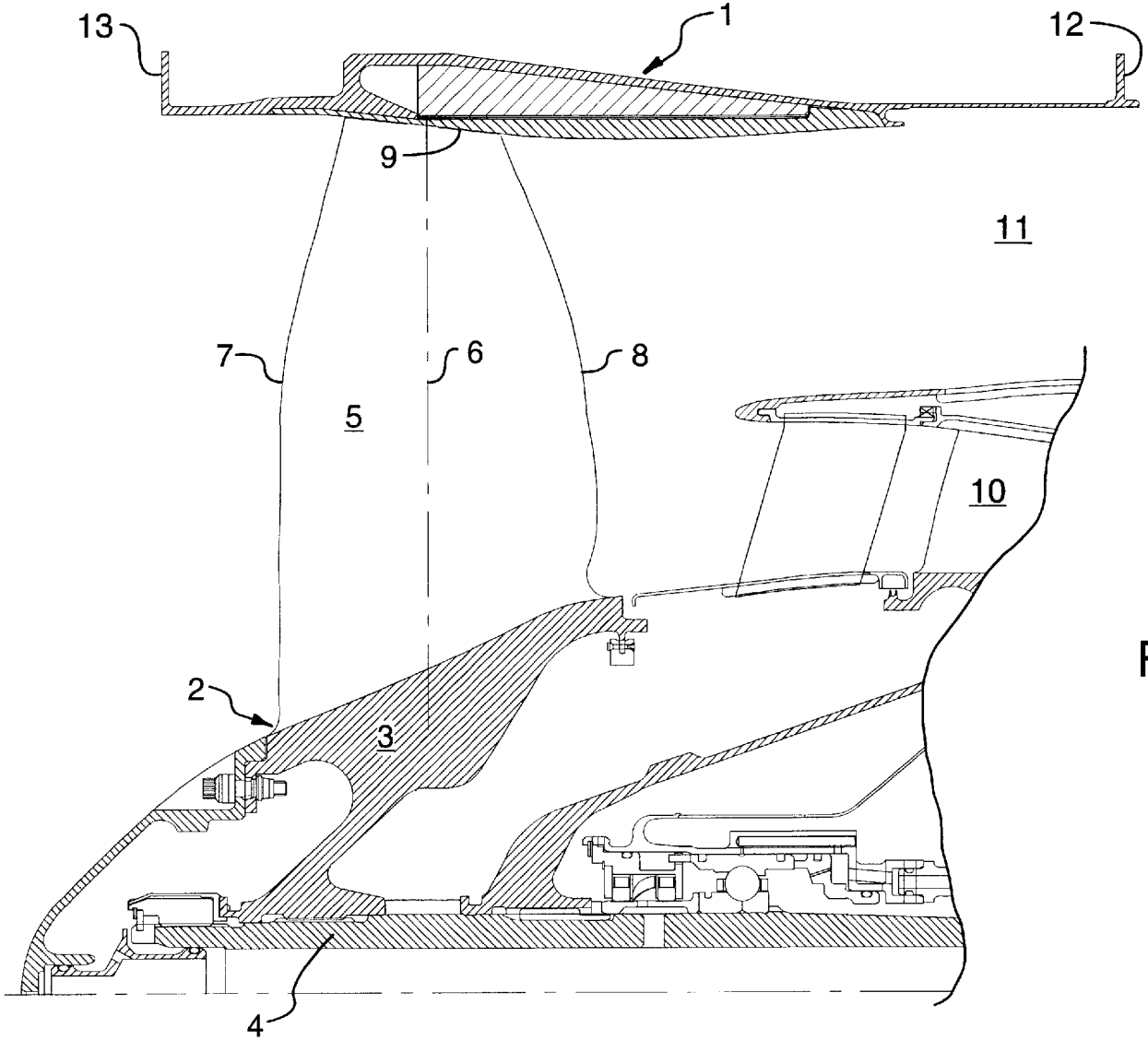
FIG. 1 is a partial axial view showing one-half of a fan rotor with blade and the fan case according to the invention disposed radially outwardly from the fan blades.

Referring to FIG. 1, the invention provides a novel hardwall fan case 1 that encases the radial periphery of a forward fan 2 of a turbofan engine. The fan 2 is illustrated as an integrally bladed fan with a hub 3 mounted to a shaft 4 and having a circumferentially spaced apart array of fan blades 5. Each fan blade has a center of gravity (indicated as disposed on vertical plane 6), a leading edge 7, a trailing edge 8, and a fan tip 9. As is conventional, the fan 2 conducts a primary flow of air through the core duct 10 into the compressor and turbine sections of the engine and a by-pass duct 11 external to the engine core.

The fan case 1 is mounted to the intermediate case on a rearward flange 12 and includes a forward flange 13 on which the inlet structure or bell mouth can be mounted.

Figure 2:
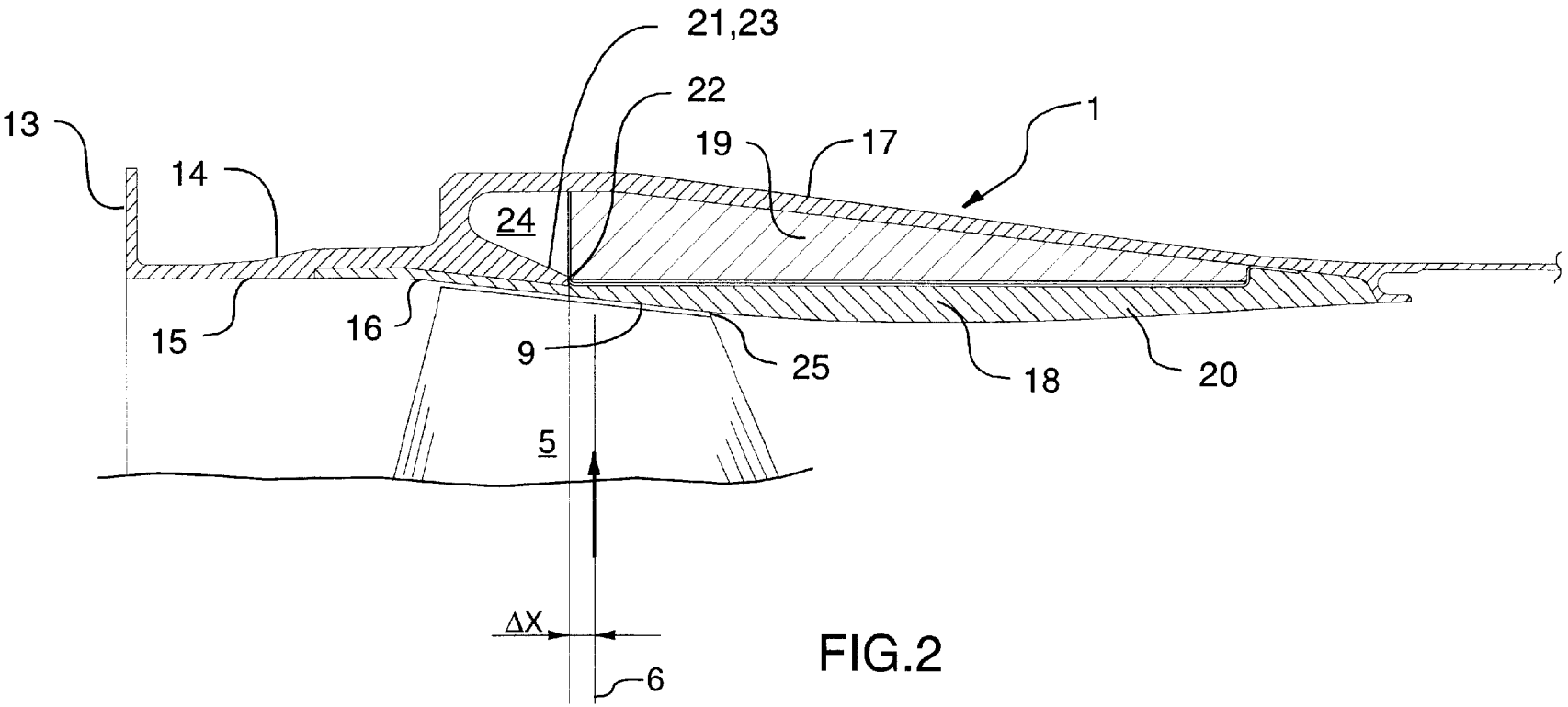
FIG. 2 is a detailed partial axially sectional view showing the fan case with rigid metal fan case shell, compressible material and abradable material defining the annular internal air path surface of the fan case and showing the tip area of the fan blade.

Referring to FIG. 2, the detailed construction of the fan case 1 is illustrated. Radial clearance 25 between the fan blade tip 9 and the fan case 1 is shown in an exaggerated scale for illustration purposes only.

The fan case 1 includes a rigid annular shell 14 which is machined of steel or metal alloy. The rigid annular shell 14 is spaced at a selected radial distance from the fan tip 9. The internal surface of the shell 14 defines an annular internal air path surface of the fan case 1.

The rigid shell 14 includes a fore section 15 opposite the leading edge 7 and forward portion of the blade tip 9. The rigid fore section 15 has an inner surface which is substantially parallel to the fan blade tips 9 and includes a fore layer 16 of abradable material on the inner surface. The fore layer of abradable material has a thickness which will limit the tip clearance during a bird strike event, and will permit the metal of the blade tip 9 to contact the metal of the rigid annular shell 14 in the fore section area 15. To limit the range of tip clearance therefore, the fore layer 16 of abradable material has a thickness depending on the acceptable range of tip clearance for the particular fan to provide it with the engine. For example, in the event that relatively highly aerodynamically loaded fan blades are used in association with a small diameter engine, the fore layer of abradable material may have a thickness in the range of 0.010 to 0.100 inches.

The rigid annular shell 14 also includes an aft section 17 that is radially spaced from the fore section 15, thus defining a recess between the aft section 17 of the rigid shell 14 and the air path surface 18. The recess houses compressible material 19 generally of a honeycomb structure that is used to retain broken blades or blade fragments. The compressible material 19 is also inwardly coated with an aft layer 20 of abradable material. The combined thickness of the compressible material 19 and the aft abradable layer 20 is in the range of 0.250 to 0.500 inches or more.

It will be appreciated therefore, that in the case of normal operation and bird strike events, the forward portion of the blade tip 9 will be limited in its radial movement by contact with the fore section 15 of the rigid annular metal shell 14. Blade tip clearance therefore, may be maintained within acceptable limits providing essentially a hard shell forward portion to the fan case 1. However, the rear or aft section 17 of the fan case 1 provides a relatively thick layer of compressible material 19 to absorb the impact of a broken fan blade fragment and contain it.

Of particular significance is the provision of a rigid bumper 21 between the fore section 15 and aft section 17. The bumper 21 has a rigid rear edge 22 disposed an offset distance "ΔX" forwardly of the fan blade centres of gravity along line 6.

The operation of the bumper 21 and bumper edge 22 and their positioning provide for rearward deflection of broken fan blade fragments in the following manner.

A broken fan blade fragment will be directed radially outward with a trajectory disposed on plane 6 with a centrifugal force indicated schematically by an arrow in FIG. 2. When the blade fragment contacts the bumper 21, the centrifugal force of the fragment together with the offset "ΔX" results in a moment force which will rotate the fragment in a counter -clockwise direction as drawn in FIG. 2. Rotation of the blade fragment around the bumper edge 22 will result in re-directing the radial trajectory of broken fragment to an axially rearward trajectory, or alternatively will serve to direct the fragment into the compressible material 19.

The bumper edge 22 in the embodiment illustrated is disposed on a rearwardly extending cantilever bumper flange 23. This configuration provides blade fragment retention means for housing a broken blade fragment radially outwardly of the bumper flange 23 in an air filled pocket 24. By providing the pocket 24 and a relatively thick layer of compressible 19, the broken blade fragments can be retained out of contact with the remaining blades of the fan, thereby reducing the risk of blade fragmentation and further damage to the remaining fan blades.

The bumper flange 23 is tapered rearwardly with decreasing thickness for superior structural strength, and also to provide a surface for releasing the blade fragments stored within the pocket 24. As indicated in FIG. 2, it is preferred that the combined thickness of the compressible material 19 and aft abradable material 20 are tapered with rearwardly decreasing combined thickness also to permit axial rearward expulsion of any broken blade fragments.

Therefore, the invention provides several advantageous over the prior art as follows. The fore section 15 with relatively thin layer of abradable material 16 provides the functioning of a hardwall fan case to minimize the tip clearance in the event of bird strike. Where prior art fan cases use a relatively thick layer of compressible material on bird strike such prior art fan cases experience excessive fan tip clearance which can be severe enough to cause fan stalling or engine surging. In order to overcome the disadvantages of a complete prior art hardwall fan case, the invention provides a thick layer of compressible material within a recess in the aft section 17 and a rigid bumper 21 with bumper edge 22 positioned offset from the fan blade centre of gravity. Broken fan blade fragments are rotated and deflected from a radial trajectory to an axially rearward trajectory on contact with the rigid bumper 21.

Although the above description and accompanying drawings relate to a specific preferred embodiment as presently contemplated by the inventors, it will be understood that the invention in its broad aspect includes mechanical and functional equivalents of the elements described and illustrated.

The embodiments of the invention in which an exclusive property or privilege is claimed are defined as follows:

1. A hardwall fan case for encasing the radial periphery of a forward fan in a gas turbine engine, the fan including a circumferentially spaced apart array of fan blades each having: a centre of gravity; a leading edge; a trailing edge; and a tip, the fan case comprising:

a rigid annular shell spaced a selected radial distance from the tips of the fan blades defining an annular internal air path surface of the fan case, the shell comprising:

a fore section;

an aft section radially spaced from the fore section thus defining a recess between the aft section of the rigid shell and the air path surface, said recess housing compressible material; and rigid bumper means, between the fore and aft sections, for deflecting a broken fan blade fragment rearwardly, the bumper means comprising a bumper having a rigid rear edge disposed an offset distance forwardly of the fan blade centres of gravity, whereby the broken blade fragment projectile on impact with the rigid rear edge of the bumper rotates rearwardly about the rigid rear edge under a resulting force moment proportional to the inertial force of the fragment and proportional to said offset distance.

2. A hardwall fan case according to claim 1 wherein the rigid shell fore section has an inner surface substantially parallel to the fan blade tips, and includes a fore layer of abradable material on said inner surface.

3. A hardwall fan case according to claim 2 wherein the fore layer of abradable material has a thickness in the range of 0.010 to 0.100 inches.

4. A hardwall fan case according to claim 1 wherein compressible material housed in the aft section recess is inwardly coated with an aft layer of abradable material.

5. A hardwall fan case according to claim 4 wherein the compressible material and aft abradable layer have a combined thickness in the range of 0.250 to 0.500 inches.

6. A hardwall fan case according to claim 5 wherein the combined thickness of the compressible and aft abradable materials are tapered having a rearwardly decreasing combined thickness.

7. A hardwall fan case according to claim 1 wherein the bumper edge is disposed on a rearwardly extending bumper flange.

8. A hardwall fan case according to claim 7 including blade fragment retention means for housing a broken blade fragment radially outward of the bumper flange.

9. A hardwall fan case according to claim 8 wherein the blade fragment retention means comprises a pocket between the bumper flange and the aft shell section.

10. A hardwall fan case according to claim 9 wherein the pocket is air filled.

11. A hardwall fan case according to claim 7, wherein the bumper flange is tapered having a rearwardly decreasing thickness.

* * * * *